US007748811B2

(12) United States Patent
Yamashita

(10) Patent No.: US 7,748,811 B2
(45) Date of Patent: Jul. 6, 2010

(54) LIQUID JET APPARATUS

(75) Inventor: Noriaki Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 743 days.

(21) Appl. No.: 11/613,957

(22) Filed: Dec. 20, 2006

(65) Prior Publication Data

US 2007/0140917 A1 Jun. 21, 2007

(30) Foreign Application Priority Data

Dec. 21, 2005 (JP) ..... 2005-367724

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS 6,494,554 B1 * 12/2002 Horii et al. ..... 347/10

FOREIGN PATENT DOCUMENTS

JP 10-278269 10/1998
JP 2000-085123 3/2000
JP 2001-010049 1/2001
JP 2003-170591 6/2003
JP 2003-237113 8/2003
JP 2004-090542 3/2004
JP 2004-203060 7/2004
JP 2004203060 A * 7/2004 ..... 347/11
JP 2005-014431 1/2005
JP 2006-082376 3/2006
JP 2002-046265 12/2006

* cited by examiner

*Primary Examiner*—Julian D Huffman
*Assistant Examiner*—Jason S Uhlenhake
(74) *Attorney, Agent, or Firm*—Workman Nydegger

(57) ABSTRACT

A liquid jet apparatus includes a liquid jet head and a driving signal generating circuit. The driving signal generating circuit generates driving signals including ejection pulses to control the ejection of liquid droplets. A first driving signal is supplied to a first actuator unit and a second driving signal is supplied to a second actuator unit. A first ejection pulse is generated, followed by a second ejection pulse generated after a delay time of Δt. The delay time Δt is set within a range that allows a liquid droplet to be ejected with reduced misting and reduced deviation from a predetermined path.

17 Claims, 11 Drawing Sheets

LIQUID JET APPARATUS

CROSS-REFERENCE TO RELATED APPLICATIONS

This application claims priority to Japanese Patent Application No. 2005-367724, filed Dec. 21, 2005, which is hereby incorporated by reference.

BACKGROUND

1. Technical Field

The present invention relates to a liquid jet apparatus, such as an inkjet printer, and more particularly to a liquid jet apparatus whose ejection of liquid droplets is controllable by using a plurality of driving signals.

2. Related Art

A liquid jet apparatus includes a liquid jet head capable of ejecting liquid droplets. The apparatus ejects various types of liquid through the head. Typical examples of such a liquid jet apparatus include an inkjet recording apparatus (printer) having an inkjet recording head (hereinafter referred to as the "recording head") that ejects droplets of liquid ink, as well as other types of image recording apparatus. In addition, display manufacturing apparatus and various other types of apparatus in which the above-mentioned feature is applied have been available in recent years.

The recording head as an example of the liquid jet head is provided with a continuous ink canal from a common ink (liquid) chamber to nozzles via a pressure chamber. By actuating pressure-generating elements, such as piezoelectric oscillating elements, to change pressure on the liquid in the pressure chamber, the recording head ejects droplets of the ink contained in the pressure chamber. For example, the recording head includes actuator units (oscillator unit) each having a piezoelectric-oscillating-element group joined to a fixing plate, resin head cases each having an accommodation chamber provided for each actuator unit to accommodate the unit, and a canal unit that defines the ink canal.

The canal unit includes, for example, a nozzle plate having a plurality of nozzle openings in row, a canal-forming substrate having a canal base to serve as an ink canal for the pressure chamber, and a sealing plate (oscillating plate) to seal the opening of the canal base in the substrate. The unit has a multilayer structure in which these elements are stacked on top of each other and unified. The sealing plate is made of a compound plate material formed by, for example, laminating a resin film on a stainless steel supporting plate and partly removing the supporting plate. An area on the sealing plate corresponding to the pressure chamber has a diaphragm part that changes the volume of the chamber. The diaphragm part is formed by etching and circularly removing parts of the supporting plate around an area (insular portion) joining the tip of each piezoelectric oscillating element to leave the resin film only.

A free end of each piezoelectric oscillating element in each actuator unit is exposed to the outside of the case through the opening of the accommodation chamber of the case on the canal unit side. The tip of the free end is joined to the insular portion included in the diaphragm part of the sealing plate. By changing the shape of the diaphragm part of the sealing plate with the piezoelectric oscillating element stretching, the volume of the pressure chamber can be increased or decreased. The fixing plate of the actuator unit is made of a stainless steel plate member, for example, and is bonded to an inner wall surface of the accommodation chamber of the case. JP-A-2004-203060 (FIG. 8) is an example of related art.

To miniaturize such a recording head to have a lightweight and space-economical structure, the case and a partition wall defining adjacent accommodation chambers in the case are required to be thinner. Consequently, for example, when one of the actuator units each accommodated in one accommodation chamber is driven to eject ink droplets, the stress generated as a result of a change in the shape of the resin film by the movement of the diaphragm part of the sealing plate may possibly be transmitted to the partition wall, thereby vibrating the wall. If the vibration of the wall is transmitted to the diaphragm part in the other actuator unit, the ejection rate of ink droplets ejected by the driving of this actuator unit may be lowered depending on the phase of the vibration. As the ejection rate of ink droplets ejected is lowered, the airborne droplets may become mist, so that they cannot reach a subject (e.g. recording paper) onto which the ink is ejected. Also, the droplets may not be ejected straight, so that they cannot reach the expected position. These phenomena will degrade the quality of recorded images.

SUMMARY

An advantage of the present invention is to provide a liquid jet apparatus to reduce degradation of liquid ejection characteristics for ejecting liquid droplets by driving actuator units accommodated in adjacent accommodation chambers in an identical ejection cycle.

A liquid jet apparatus according to one aspect of the invention includes a liquid jet head and a driving signal generating circuit. The liquid jet head includes a canal unit, actuator units, and a head case. The canal unit defines a continuous liquid canal from a common liquid chamber to a nozzle opening via a pressure chamber, and includes a diaphragm part that changes a volume of the pressure chamber on an area corresponding to the pressure chamber. Each actuator unit includes a pressure generating element that changes the shape of the diaphragm part which changes the pressure on liquid contained in the pressure chamber. The head case includes accommodation chambers provided for the actuator unit to accommodate the actuator unit and also includes a canal fixing surface that fixes the canal unit. The liquid jet head ejects a liquid droplet from the nozzle opening by using the change in pressure on the liquid contained in the pressure chamber made by driving the pressure generating element. The driving signal generating circuit generates driving signals including ejection pulses to drive the pressure generating element to eject a liquid droplet. Of the driving signals the driving signal generating circuit generates, a first driving signal is supplied to a first actuator unit of the actuator units accommodated in the accommodation chambers placed next to each other with a partition wall of the head case therebetween, and a second driving signal is supplied to a second actuator unit. Of the ejection pulses of the second driving signal, a second ejection pulse is generated with a delay time of $\Delta t$ from the generation of a first ejection pulse of the ejection pulses of the first driving signal. The delay time $\Delta t$ is set within a range that allows a liquid droplet ejection rate Vd of the second actuator unit with both the actuator units driven to eject a liquid droplet in an identical ejection cycle to be equal to or higher than another liquid droplet ejection rate Va with one of the actuator units driven to eject a liquid droplet.

Since the delay time $\Delta t$ of the generation timing of the second ejection pulse from the generation timing of the first ejection pulse is set within the range that allows the liquid droplet ejection rate Vd of the second actuator unit with both the actuator units driven to eject a liquid droplet in an identical ejection cycle to be equal to or higher than the liquid droplet ejection rate Va with one of the actuator units driven to eject a liquid droplet, it is possible to prevent a decrease in the liquid droplet ejection rate attributed to vibration of the partition wall even when both of the actuators accommodated in the accommodation chambers placed next to each other are driven in an identical ejection cycle to eject a liquid droplet. It is therefore possible to prevent the liquid droplet from becoming mist or deviating and thus to accurately mount the droplet on a subject onto which liquid is ejected.

A liquid jet apparatus according to another aspect of the invention includes a liquid jet head and a driving signal generating circuit. The liquid jet head includes a canal unit, actuator units, and a head case. The canal unit defines a continuous liquid canal from a common liquid chamber to a nozzle opening via a pressure chamber, and includes a diaphragm part that changes a volume of the pressure chamber on an area corresponding to the pressure chamber. Each actuator unit includes a pressure generating element that changes shape of the diaphragm part to change pressure on liquid contained in the pressure chamber. The head case includes accommodation chambers each provided for the actuator unit to accommodate the actuator unit and also includes a canal fixing surface that fixes the canal unit. The liquid jet head ejects a liquid droplet from the nozzle opening by using the change in pressure on the liquid contained in the pressure chamber made by driving the pressure generating element. The driving signal generating circuit generates driving signals including ejection pulses to drive the pressure generating element to eject a liquid droplet. Of the driving signals the driving signal generating circuit generates, a first driving signal is supplied to a first actuator unit out of the actuator units accommodated in the accommodation chambers placed next to each other with a partition wall of the head case therebetween, and a second driving signal is supplied to a second actuator unit. Of the ejection pulses of the second driving signal, a second ejection pulse is delayed by a delay time Δt from the generation of a first ejection pulse of the ejection pulses of the first driving signal. The delay time Δt falls within a range of plus or minus Tw/4 of Tw−Tp where Tw represents a natural vibration cycle of the partition wall and Tp represents a driving time from the start of driving of the pressure generating element with the second ejection pulse of the second driving signal to the ejection of a liquid droplet.

Since the delay time Δt of the generation timing of the second ejection pulse from the generation timing of the first ejection pulse is set within the range of plus or minus Tw/4 of Tw−Tp, it is possible to allow the liquid droplet ejection rate Vd of the second actuator unit with both the actuator units accommodated in the accommodation chambers placed next to each other driven to eject a liquid droplet in an identical ejection cycle to be equal to or higher than the liquid droplet ejection rate (target ejection rate) Va with one of the actuator units driven to eject a liquid droplet. In other words, by setting the delay time Δt Tw−Tp, a liquid droplet is ejected by the second actuator unit with a phase that makes the vibration of the partition wall transmitted to the ejection side nearly maximum. Therefore, the liquid droplet ejection rate Vd becomes almost the maximum. By setting the delay time Δt within the range of plus or minus Tw/4 of Tw−Tp, the ejection rate Vd becomes equal to or higher than the target ejection rate Va. In addition, by thus setting the delay time Δt of the second ejection pulse, the first actuator unit can be driven without an influence of the vibration of the partition wall made by the driving of the second actuator unit. Accordingly, the ejection rate of liquid droplets ejected by the driving of both of the actuator units can be equal to or higher than the target ejection rate. It is therefore possible to prevent liquid droplets from becoming mist or deviating, thereby accurately mounting the droplets on the subject.

In one embodiment, the first and second driving signals may include a plurality of ejection pulses for ejecting different amounts of liquid droplets in an identical ejection cycle, and each ejection pulse of the second driving signal may be generated with the delay time Δt from the timing of generating the corresponding first ejection pulses of the first driving signal.

In another embodiment, the first and second driving signals include a plurality of ejection pulses for ejecting different amounts of liquid droplets in an identical ejection cycle, and at least a second minimum droplet ejection pulse of the ejection pulses of the second driving signal for ejecting a minimum droplet amount be generated with the delay time Δt from the timing of generating a first minimum droplet ejection pulse of the first driving signal.

A droplet in the minimum amount is most likely to deviate or become mist. Therefore, by generating the second minimum droplet ejection pulse with the delay time Δt from the timing of generating the first minimum droplet ejection pulse, it is possible to prevent the droplet ejected by using the second minimum droplet ejection pulse from becoming mist or deviating and thus accurately mount ink droplets on the subject.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of the invention will be described with reference to the accompanying drawings. It should be appreciated that the following description of the example embodiments is not intended to limit the scope of the invention unless any limitation on the invention is specified. As the above-described liquid jet apparatus, an inkjet recording apparatus (hereinafter referred to as the "printer") will now be described.

Figure 1:
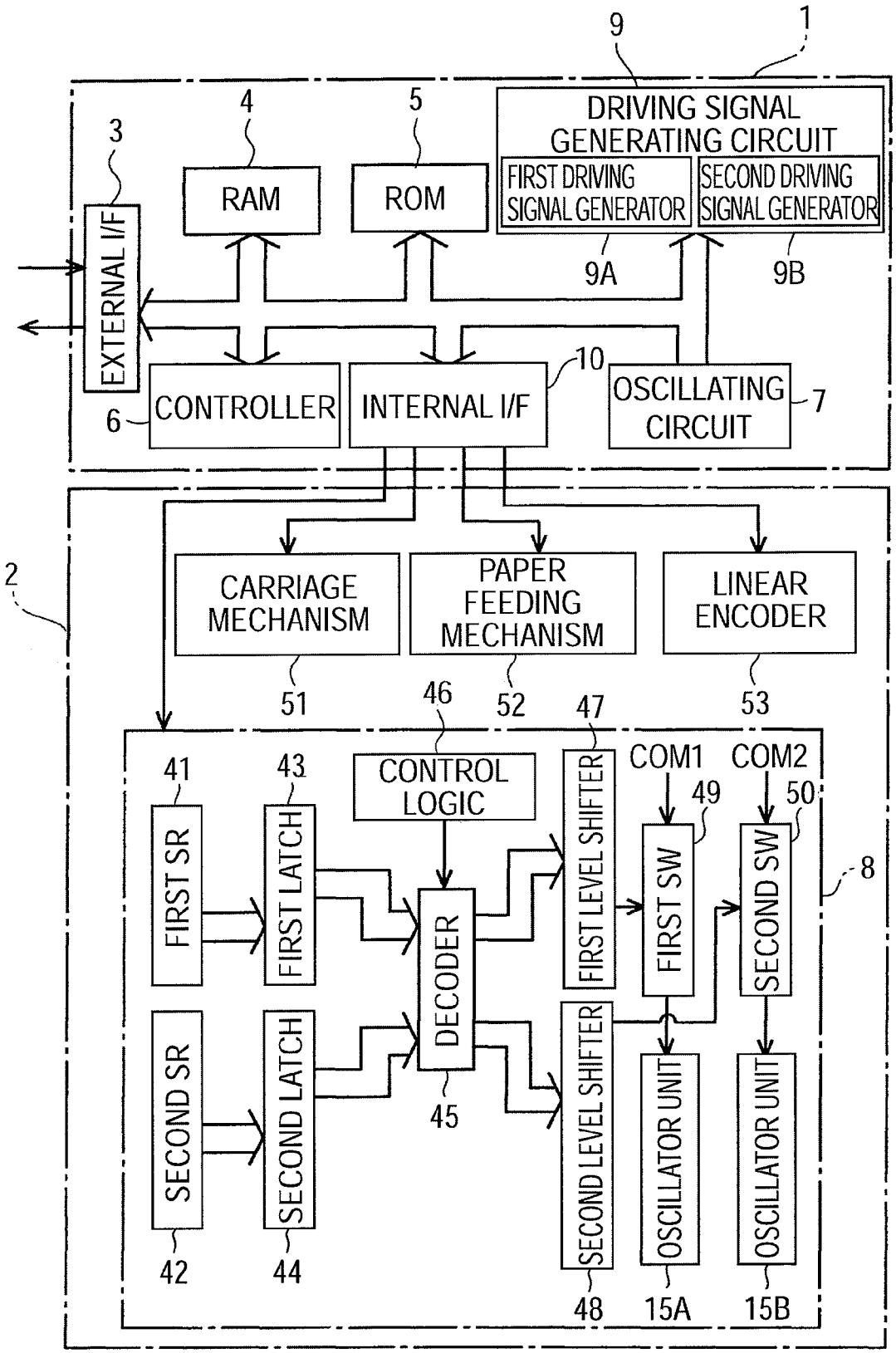
FIG. 1 is a functional block diagram of an inkjet printer.

FIG. 1 is a block diagram showing the electrical configuration of an example printer. The printer shown in the drawing includes a printer controller 1 and a print engine 2. The printer controller 1 includes an external interface (I/F) 3, a random access memory (RAM) 4, a read-only memory (ROM) 5, a controller 6, an oscillating circuit 7, a driving signal generating circuit 9, and an internal interface (I/F) 10. The external I/F 3 transmits and receives data to and from a host computer or other external devices (not shown). The RAM 4 stores various types of data, for example. The ROM 5 stores a control program for processing various types of data, for example. The controller 6 includes a central processing unit (CPU), for example. The oscillating circuit 7 generates clock signals, while the driving signal generating circuit 9 generates driving signals COM1 and COM2 to be supplied to a recording head 8. The internal I/F 10 transmits recording data and the driving signals, for example, to the print engine 2.

The external I/F 3 receives image data and other printing data from a host computer, for example. The external I/F 3 also outputs busy or acknowledge signals and other status signals to an external device. The RAM 4 serves as a receiving buffer, intermediate buffer, output buffer, and work memory, for example. The ROM 5 stores various types of control programs executed by the controller 6, font data and graphic functions, and various types of processes, for example.

Figure 2:
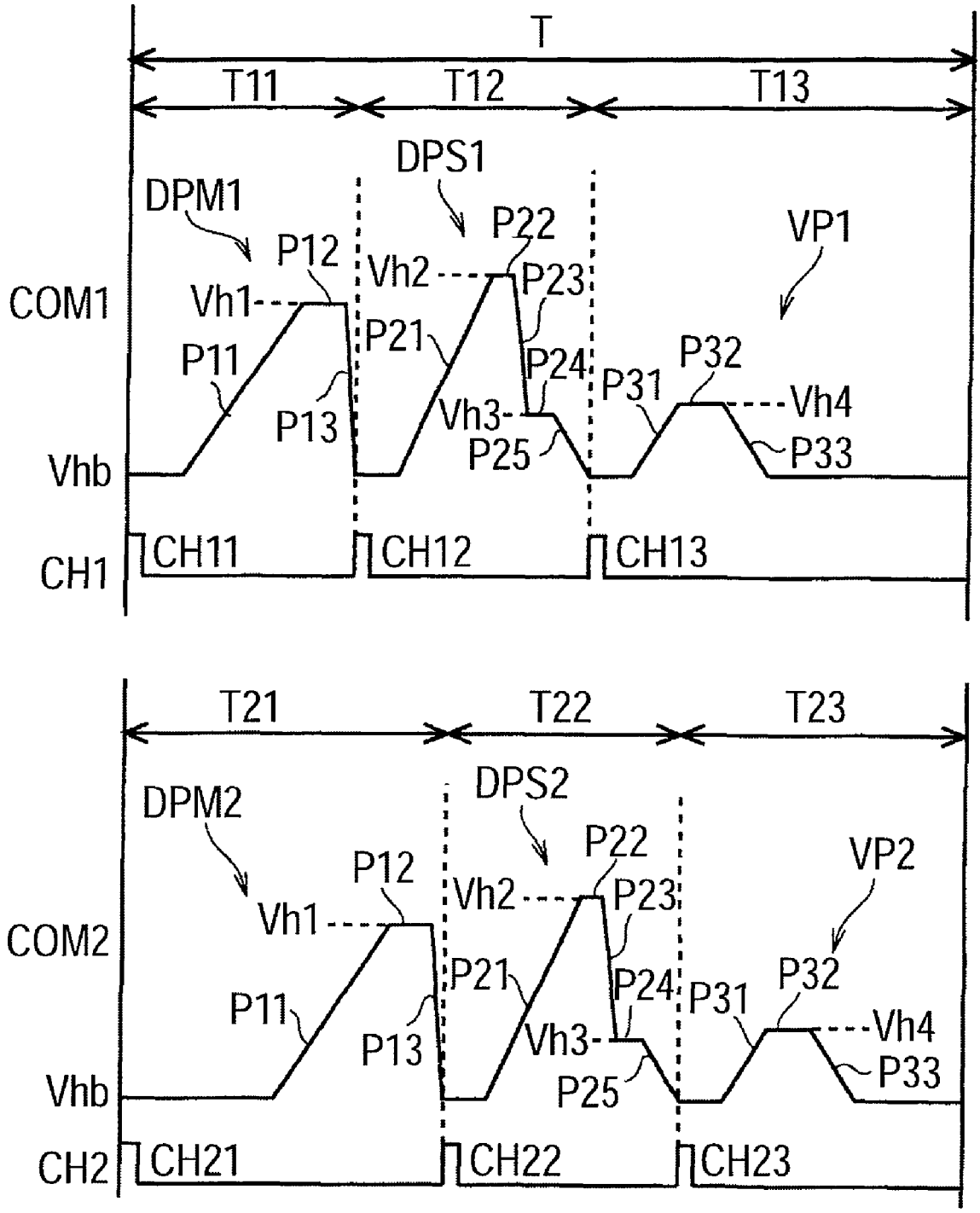
FIG. 2 illustrates the configuration of driving signals.

The driving signal generating circuit 9 includes a first driving signal generator 9A capable of generating the first driving signal COM1 and a second driving signal generator 9B capable of generating the second driving signal COM 2. Referring to FIG. 2, the first driving signal COM1 has a series of pulses composed of a first middle-dot ejection pulse DPM1, a first small-dot ejection pulse DPS1 (an example of the first minimum droplet ejection pulse), and a first micro-vibrating pulse VP1 within an ejection (recording) cycle T. The generation of the signal is repeated every cycle T. According to this embodiment, the cycle T for ejecting the first driving signal COM1 has three periods (pulse generation periods) T11 to T13. Of the first driving signal COM1, the first middle-dot ejection pulse DPM1 is generated in the period T11, the first small-dot ejection pulse DPS1 in the period T12, and the first micro-vibrating pulse VP1 in the period T13. The first middle-dot ejection pulse DPM1 and first small-dot ejection pulse DPS1, according to this embodiment, correspond to the above-described first ejection pulse.

The second driving signal COM2 has a series of pulses composed of a second middle-dot ejection pulse DPM2, a second small-dot ejection pulse DPS2 (an example of the second minimum droplet ejection pulse), and a second micro-vibrating pulse VP2 within the ejection period T. The cycle T for ejecting the second driving signal COM2 has three pulse generation periods T21 to T23. The second middle-dot ejection pulse DPM2 is generated in the period T21, the second small-dot ejection pulse DPS2 in the period T22, and the second micro-vibrating pulse VP2 in the period T23. The second middle-dot ejection pulse DPM2 and second small-dot ejection pulse DPS2 according to this embodiment correspond to the above-described second ejection pulse. The driving signals COM1 and COM2 will be described in greater detail later.

Referring again to FIG. 1, The controller 6 controls the elements of the printer in accordance with the control program etc. stored in the ROM 5 and develops the printing data input from an external device to recording data to be output to the recording head 8. To develop the data, the controller 6 reads the printing data stored in the RAM 4, converts the data into an intermediate code, and stores the data of this code in the intermediate buffer in the RAM 4. The controller 6 then analyzes the intermediate code data read out from the intermediate buffer, and develops the data into per-dot recording data (dot pattern data) with reference to the font data and graphic functions stored in the ROM 5. Furthermore, the controller 6 supplies latch signals (LAT) and channel signals (CH) to the recording head 8 via the internal I/F 10. Latch pulses of the latch signal and channel pulses of the channel signal specify the timing at which each pulse of the driving signals COM1 and COM2 is supplied.

The print engine 2 will now be described. Referring to FIG. 1, the print engine 2 includes the recording head 8, a carriage mechanism 51, a paper feeding mechanism 52, and a linear encoder 53, for example. Although not shown, the carriage mechanism 51 includes a carriage to which the recording head 8, as an example of the liquid jet head, is mounted and also includes a driving motor (e.g. DC motor) for driving the carriage through a timing belt, for example. This mechanism 51 moves the head 8 mounted on the carriage in a main scanning direction. The paper feeding mechanism 52 includes a paper feeding motor and a paper feeding roller. This mechanism 52 feeds recording paper (an example of the subject onto which liquid is ejected) sequentially onto a platen to perform subordinate scanning. The linear encoder 53 provides the controller 6 with encoder pulses depending on the scanning position of the head 8 mounted on the carriage as position information in the main scanning direction via the internal I/F 10. The controller 6 acknowledges the scanning position (current position) of the head 8 based on the encoder pulses received from the linear encoder 53.

Figure 3:
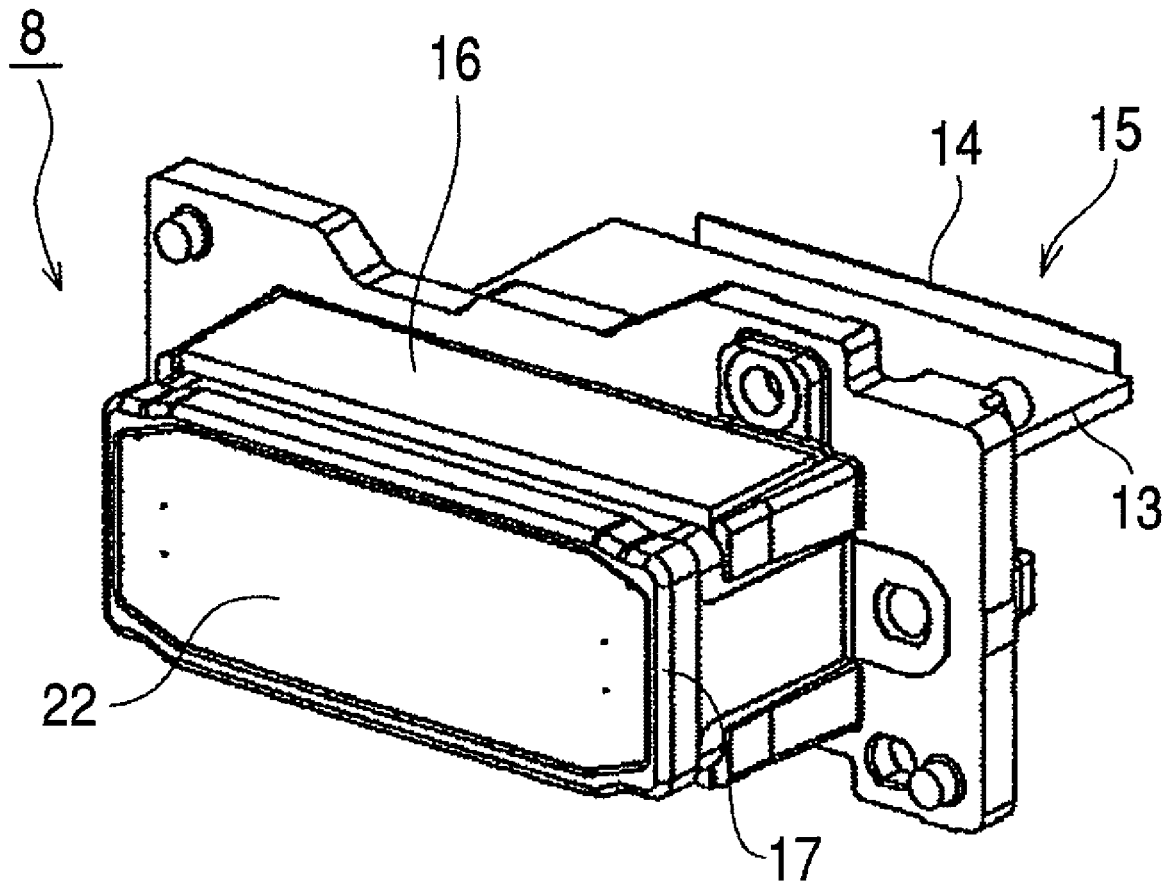
FIG. 3 is a perspective view of a recording head seen from the lower side.
Figure 4:
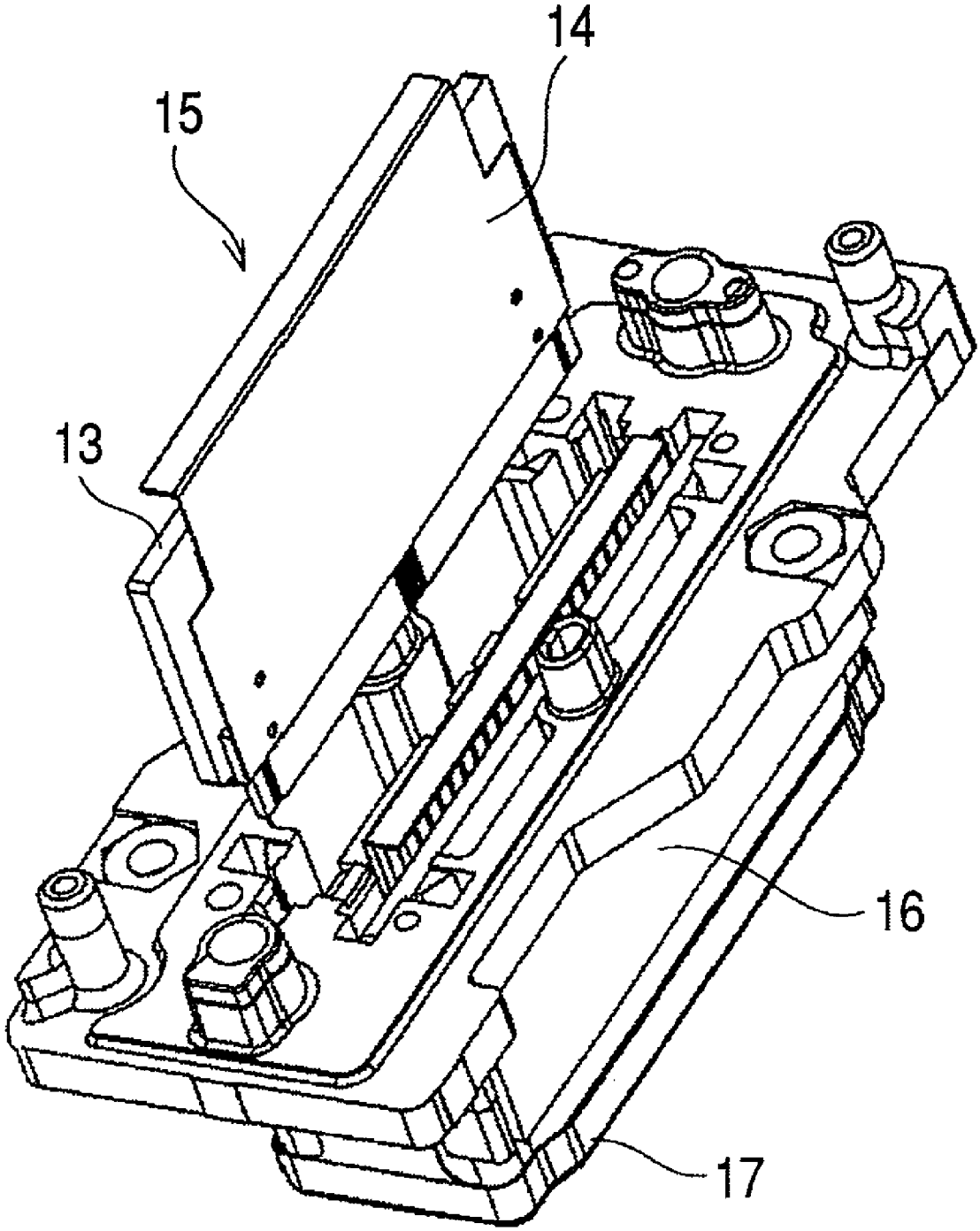
FIG. 4 is another perspective view of the recording head seen from the upper side.
Figure 5:
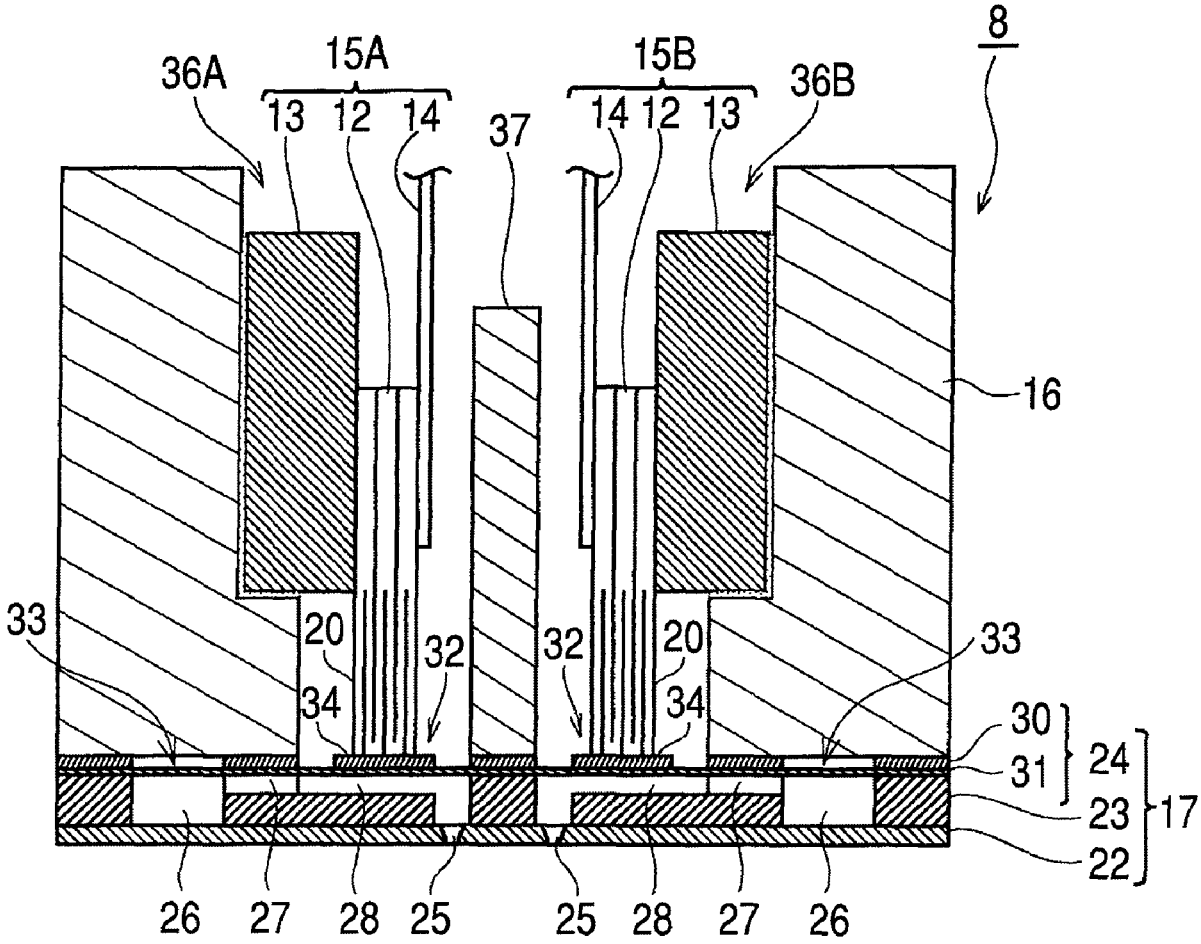
FIG. 5 is a sectional view showing key elements of the recording head.

FIG. 3 is a perspective view of the recording head 8 seen from the lower side (where nozzle openings are formed). FIG. 4 is another perspective view of the head 8 seen from the upper side. FIG. 5 is a sectional view showing key elements of the head 8. The recording head 8 according to this embodiment includes an oscillator unit 15 (also referred to as an actuator unit) including a piezoelectric-oscillating-element group 12, a fixing plate 13, and a flexible cable 14 as a unit; a head case 16 capable of accommodating the oscillator unit 15; and a canal unit 17 defining a continuous ink canal (liquid canal) from a common ink chamber (common liquid chamber) to the nozzle openings via a pressure chamber.

The oscillator unit 15 will now be described. In the piezoelectric-oscillating-element group 12, piezoelectric oscillating elements 20 (also referred to as a pressure generating element) may be arranged in an elongated comb-like shape with a very fine width of about several dozen micrometers. The piezoelectric oscillating elements 20 are stretchable in the longitudinal direction to provide longitudinal vibration. A fixed end of each piezoelectric oscillating element 20 is joined to the fixing plate 13, while another end that is referred to as a free end protrudes farther than the tip of the fixing plate 13, similar to a cantilever. The tip of the free end of each piezoelectric oscillating element 20 is, as described later, joined to an insular portion 34 of a diaphragm part 32 included in the canal unit 17. The flexible cable 14 is electrically coupled to the piezoelectric oscillating elements 20 at one side of the fixed end that is remote from the fixing plate 13. The fixing plate 13 supporting each piezoelectric oscillating element 20 is made of a plate material, such as a metal plate material, that is rigid enough to accept the reaction force of the piezoelectric oscillating elements 20. According to the present embodiment, the piezoelectric oscillating element is made of a stainless steel plate having a thickness of about one millimeter. The oscillator unit 15 is provided corresponding to each nozzle array. In this embodiment, two oscillator units, namely, a first oscillator unit 15A (corresponding to the above-mentioned first actuator unit) and a second oscillator unit 15B (corresponding to the above-mentioned second actuator unit) are provided corresponding to two nozzle arrays.

The canal unit 17 will now be described. Referring to FIG. 5, the canal unit 17 includes a nozzle plate 22, a canal-forming substrate 23, and an oscillating plate 24. The nozzle plate 22 and the oscillating plate 24 are provided on opposite sides of the substrate 23 to form a multilayer that is bonded or otherwise unified.

The nozzle plate 22 is a thin, stainless steel plate having a plurality of nozzle openings 25 with a pitch corresponding to a dot density. The structure according to the present embodiment includes, for example, two adjacent nozzle arrays each of which may have 180 nozzle openings 25 in a row.

The canal-forming substrate 23 is made of a plate member defining a continuous ink canal (also referred to as a liquid canal) composed of a common ink chamber 26, an ink supply 27, and pressure chambers 28. Specifically, the canal-forming substrate 23 is made of a plate member defining a plurality of spaces separated by partitions to serve as the pressure chambers 28 corresponding to the nozzle openings 25, and other spaces to serve as the ink supply 27 and the common ink chamber 26. The canal-forming substrate 23 according to this embodiment is provided by etching a silicon wafer. Each of the pressure chambers 28 may be elongated in a direction perpendicular to another direction in which the nozzle openings 25 are arrayed (nozzle array direction). The ink supply 27 may include a narrow canal width and may be in communication with the pressure chambers 28 and the common ink chamber 26. The common ink chamber 26 is in communication with each pressure channel 28 via the ink supply 27 to supply ink stored in an ink cartridge (not shown) to each pressure chamber 28.

The oscillating plate 24 may be a two-layer compound plate material. For example, a resin film 31 may be made of polyphenylene sulfide (PPS) may be laminated on a supporting plate 30 made of stainless steel or other metal. The oscillating plate 24 may include the diaphragm part 32 that seals one opening surface of each pressure chamber 28 to change the volume of the chamber 28, and may also include a compliance part 33 that seals one opening surface of the common ink chamber 26. The diaphragm part 32 may also include the insular portion 34 to join to the tip of the free end of the piezoelectric oscillating element 20. The insular portion 34 may be formed by etching and circularly removing parts of the supporting plate 30 corresponding to the pressure chambers 28. Like the planar shape of each pressure chamber 28, the insular portion 34 may be a block elongated in the direction perpendicular to the array direction of the nozzle openings 25. The resin film 31 around the insular portion 31 functions as an elastic film. Remaining in the part functioning as the compliance part 33, namely, the area corresponding to the common ink chamber 26, is only the resin film 31, as the supporting plate 30 has been etched and removed along the opening shape of the common ink chamber 26.

While the diaphragm part 32 includes the insular portion 34 to be joined with the free end of the piezoelectric oscillating element 20 according to this embodiment, the free end may be directly joined to the surface of the resin film 31. In this case, an area joining the resin film 31 and the free end serves as the above-described diaphragm part.

Figure 7:
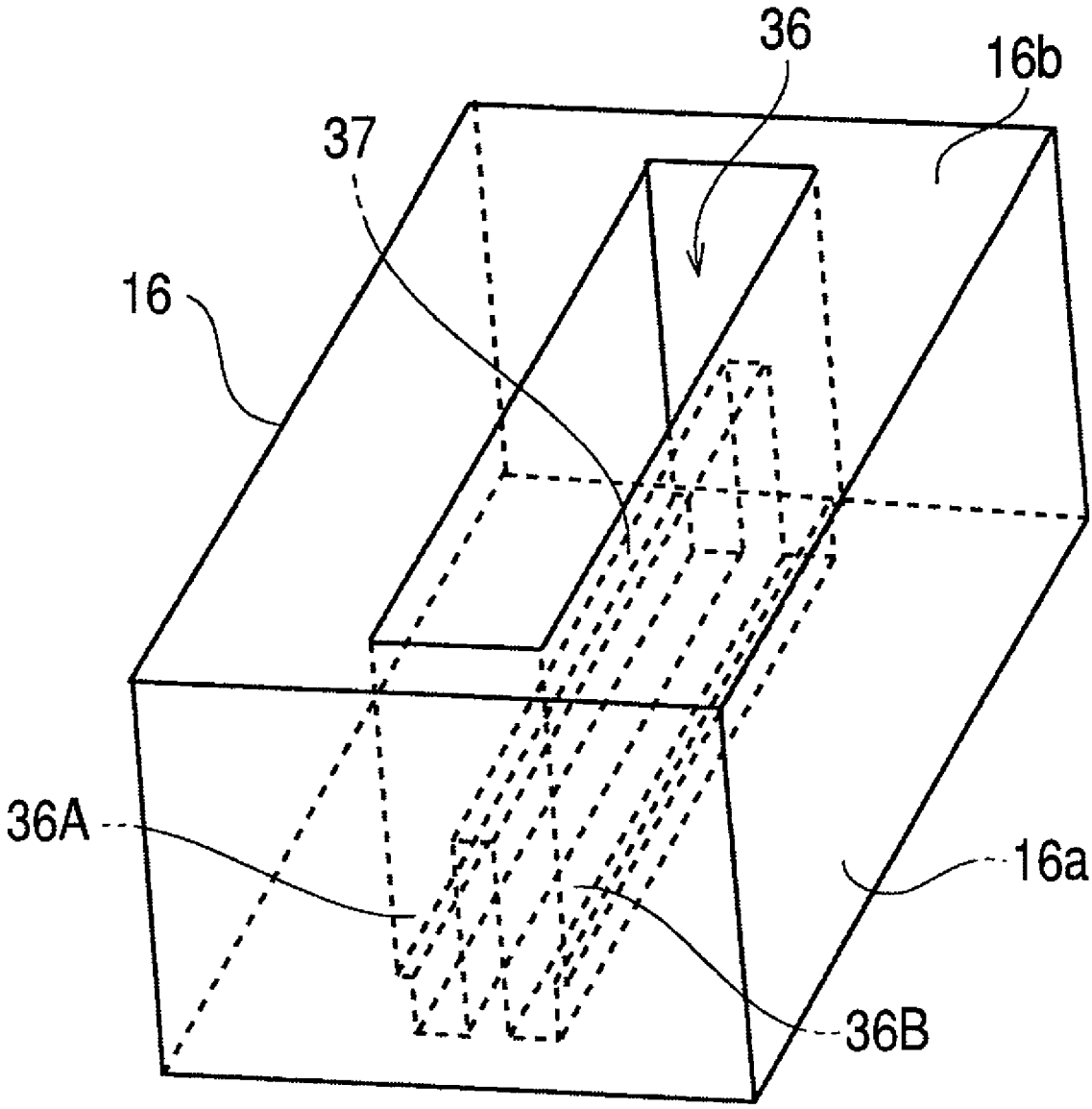
FIG. 7 is a perspective view showing the feature of a head case.
Figure 8:
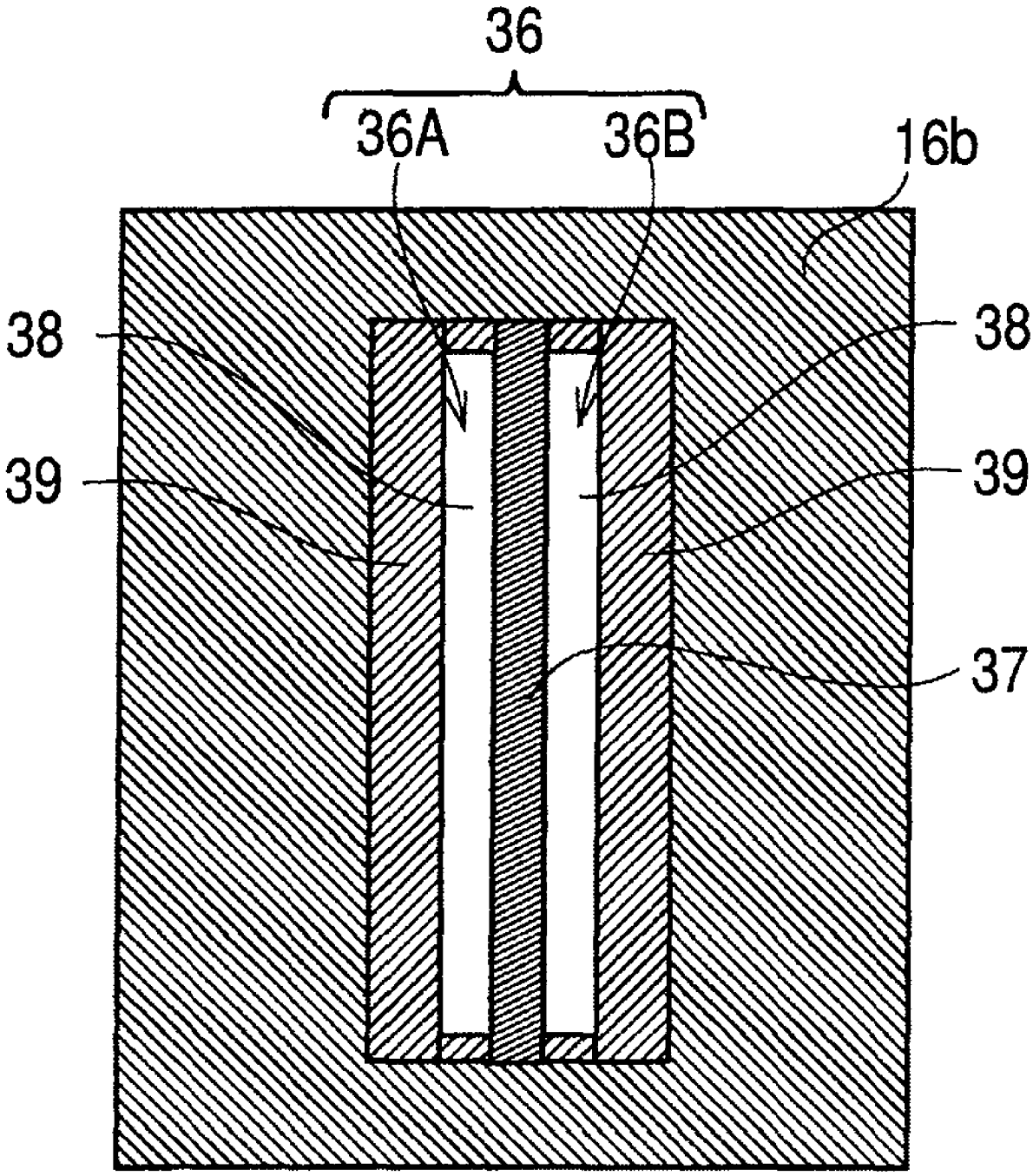
FIG. 8 is a plan view showing the feature of the head case.

FIG. 7 is a perspective view of the head case 16 seen from the upper side. FIG. 8 is an upper plan view of the head case 16. FIG. 8 shows different heights (depths) with different hatchings. The head case 16 according to this embodiment is made of a void block material made of resin. In one embodiment, a thermosetting resin, such as an epoxy resin, is used to make the head case 16 since it can be molded with high accuracy and sufficiently rigid. Provided inside the head case 16 is an accommodation chamber 36 that is capable of accommodating the oscillator unit 15. The accommodation chamber 36 penetrates the head case 16 from its canal fixing surface 16*a* that is adjacent to the canal unit 17 to its upper surface 16*b* that is on the opposite side. In other words, the accommodation chamber 36 is formed as a through hole penetrating the head case 16 in its height direction from its canal fixing surface 16*a* to its upper surface 16*b*. This accommodation chamber 36 may be provided for each oscillator unit 15. Since the recording head 8 according to the present embodiment includes two nozzle arrays, each of which is provided with one oscillator unit 15, two accommodation chambers 36, each of which accommodates one oscillator unit 15, may be arranged next to each other. Specifically, a first accommodation chamber 36A and a second accommodation chamber 36B may be placed symmetrically on either side of a partition wall 37 provided to the lower half of the accommodation chamber 36.

Each of the accommodation chambers 36A, 36B may be a continuous void including a first accommodating void 38 that is a through hole to accommodate the piezoelectric-oscillating-element group 12 and a second accommodating void 39 that is a blind hole to accommodate the fixing plate 13. The first accommodating void 38 may penetrate the head case 16 in its height direction from its canal fixing surface 16*a* to its upper surface 16*b*. The second accommodating void 39 may start from a point in the head case 16 that is a little farther than the canal fixing surface 16*a* (closer to the upper surface 16*b*) and reaches the upper surface 16*b*. The walls of the chambers 36A, 36B facing the partition wall 37 serve as bonding surfaces to which the fixing plate 13 of the oscillator unit 15 is bonded.

Figure 6:
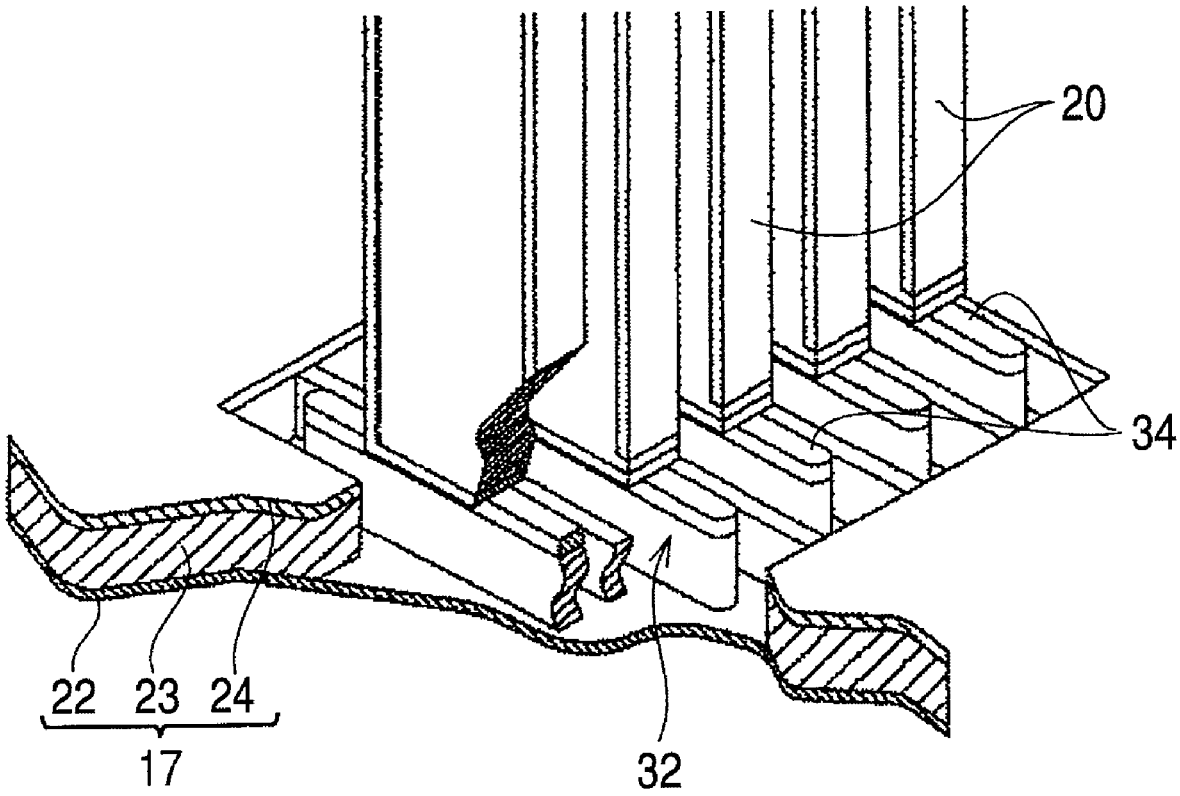
FIG. 6 is an enlarged perspective view showing an area joining a piezoelectric oscillating element and an insular portion.

The canal unit 17 may be joined to the canal fixing surface 16*a* of the head case 16. Specifically, the oscillating plate 24 may be joined to the diaphragm part 32 of the oscillating plate 24 placed in the first accommodating void 38 on the canal fixing surface. In one embodiment, an adhesive is used to fix the canal unit 17 to the head case 16. The oscillator unit 15 may be inserted into the accommodation chamber 36 from the upper opening with the free end of the piezoelectric oscillating element 20 and accommodated in the accommodation chamber 36 with the tip of the free end abutting the surface of the corresponding insular portion 34. Once the tip of the free end of the piezoelectric oscillating element 20 is joined to the insular portion 34, as shown in FIG. 6, the fixing plate 13 is bonded to a bonding surface and thus fixed in the accommodation chamber 36.

The electrical configuration of the recording head 8 will now be described. Referring to FIG. 1, the recording head 8 includes a shift register circuit having a first shift register 41 and a second shift register 42, a latch circuit having a first latch circuit 43 and a second latch circuit 44, a decoder 45, a control logic 46, a level shifter circuit having a first level shifter 47 and a second level shifter 48, a switch circuit having a first switch 49 and a second switch 50, and first and second oscillating units 15A and 15B, which may include the piezoelectric oscillating element 20, as illustrated in FIG. 5. The shift registers 41, 42, latch circuits 43, 44, level shifters 47, 48, the switches 49, 50, and oscillating units 15A, 15B may be provided in a number corresponding to the number of nozzle openings 25.

The recording head 8 ejects ink droplets based on recording data from the printer controller 1. According to the present embodiment, out of two-bit recording data, higher-order bits and lower-order bits are sent to the head 8 in this order.

Accordingly, the higher-order bits are first set to the second shift register 42. As the higher-order bits are set to the second shift register 42 of all the nozzle openings 25, the bits are shifted to the first shift register 41. At the same time, the lower-order bits are set to the second shift register 42.

The first latch circuit 43 is electrically coupled to the downstream of the first shift register 41, while the second latch circuit 44 is electrically coupled to the downstream of the second shift register 42. Receiving latch pulses from the printer control 1, the first latch circuit 43 latches the higher-order bits of the recording data, while the second latch circuit 44 latches the lower-order bits of the data. The higher and lower-order bits latched by the latch circuits 43, 44 are output to the decoder 45. The decoder 45 generates pulse selection data for selecting each pulse of the driving signals COM1 and COM2 based on the higher and lower-order bits.

The pulse selection data according to this embodiment is generated for each of the driving, signals COM1 and COM2. Specifically, first pulse selection data of the first driving signal COM1 is three-bit data composed of the first middle-dot ejection pulse DPM1 (period T11), the first small-dot ejection pulse DPS1 (period T12), and the first micro-vibrating pulse VP1 (period T13). Likewise, second pulse selection data of the second driving signal COM2 is three-bit data composed of the second middle-dot ejection pulse DPM2 (period T21), the second small-dot ejection pulse DPS2 (period T22), and the second micro-vibrating pulse VP2 (period T23).

The decoder 45 also receives timing signals from the control logic 46. The control logic 46 generates timing signals in synchronization with the input of latch and channel signals. The timing signals are generated for each of the driving signals COM1 and COM2. Each of the pulse selection data generated by the decoder 45 is input to the level shifters 47, 48, sequentially from the higher-order bits, at the timing specified with the timing signals. The level shifters 47, 48 function as voltage amplifiers. If the pulse selection data is [1], the shifters output electric signals whose voltages are boosted to about several dozen volts, for example, that is high enough to drive the corresponding switches 49, 50. In other words, electric signals are output to the first switch 49 if the first pulse selection data is [1], and electric signals are output to the second switch 50 if the second pulse selection data is [1].

The input side of the first switch 49 receives the first driving signal COM1 from the first driving signal generator 9A. The input side of the second switch 50 receives the second driving signal COM2 from the second driving signal generator 9B. The output sides of the switches 49, 50 are coupled to the first and second oscillator units 15A and 15B, respectively. In other words, the first switch 49 supplies the first driving signal COM1 to the piezoelectric oscillating element 20 in the first oscillator unit 15A, while the second switch 50 supplies the second driving signal, COM2 to the oscillating element 20 in the second oscillator unit 15B. Each of the first and second switches 49 and 50 functions as a selective supply means.

The pulse selection data controls the operations of the switches 49, 50. In one embodiment, during a period when the pulse selection data input to the first switch 49 is [1], the first switch 49 is in a conductive state and the pulses of the first driving signal COM1 are supplied to the piezoelectric oscillating element 20 in the first oscillator unit 15A. In a similar manner, during a period when the pulse selection data input to the second switch 50 is [1], the pulses of the second driving signal COM2 are supplied to the piezoelectric oscillating element 20 in the second oscillator unit 15B. During a period when the pulse selection data input to the first and second switches 49 and 50 are both [0], the switches 49,50 are shut off and no driving signals (pulses) are supplied to the oscillating element 20 in the first and second oscillator units 15A and 15B. In other words, the pulses during the period when [1] is set as the pulse selection data are selectively supplied to the oscillating element 20.

According to the present embodiment, the decoder 45, control logic 46, level shifters 47, 48, and switches 49, 50 function as pressure-generating-element controllers, and control the supply of the driving signals COM1, COM2 in accordance with recording (graduation) data, thereby controlling the operations of the piezoelectric oscillating element 20 in the first and second oscillator units 15A and 15B.

The driving signals COM1, COM2 generated by the driving signal generating circuit 9 and the control for supplying the signals to the piezoelectric oscillating element 20 will now be described.

The driving signals according to the present embodiment are the first driving signal COM1 and the second driving, signal COM2. The first driving signal COM1 drives the first oscillator unit 15A, while the second driving signal COM 2 drives the second oscillator unit 15B. Each of the driving signals COM1, COM2 has a plurality of ejection pulses for ejecting different amounts of ink droplets. According to this embodiment, each driving signal is composed of a middle-dot ejection pulse for ejecting a middle-dot amount of ink droplets and a small-dot ejection pulse for ejecting a small-dot amount of ink droplets within an ejection cycle.

Referring to FIG. 2, the first middle-dot ejection pulse DPM1 of the first driving signal COM1 generated in the period T11 and the second middle-dot ejection pulse DPM2 of the second driving signal COM2 generated in the period T21 have the same waveform that is composed of a first expansion element P11, a first expansion holding element P12, and a first contraction element P13. The first expansion element P11 is a waveform element to boost potential from a reference potential Vhb to a first expansion potential Vh1 at a constant rate that is relatively gradual so as not to eject ink droplets. The first expansion holding element P12 is a waveform element constantly at the first expansion potential Vh1. The first contraction element P13 is a waveform element to sharply lower potential from the first expansion potential Vh1 to the reference potential Vhb.

Upon the supply of the middle-dot ejection pulses DPM1 and DPM2 to the piezoelectric oscillating element 20, the element 20 contracts in the longitudinal direction because of the first expansion element P11, whereby the insular portion 34 of the diaphragm part 32 moves away from the pressure chamber 28. This movement of the insular portion 34 causes the pressure chamber 28 to expand from a reference volume based on the reference potential Vhb to an expanded volume based on the first expansion potential Vh1. This expansion of the pressure chamber 28 makes the free surface, i.e., the meniscus of the ink exposed to the nozzle openings 25 be significantly pulled toward the pressure chamber 28. At the same time, the pressure chamber 28 is provided with ink from the common ink chamber 26 via the ink supply 27. The expanded state of the pressure chamber 28 is maintained for a period when the first expansion holding element P12 is supplied. Subsequently, as the oscillating element 20 stretches with the first contraction element P13 supplied, the insular portion 34 moves close to the pressure chamber 28, whereby coming back to the position based on the reference potential Vhb. Accordingly, the pressure chamber 28 rapidly contracts from the expanded volume to the reference volume based on the reference potential Vhb. This rapid contraction of the pressure chamber 28 pressurizes the ink contained in the chamber 28, whereby the middle-dot amount of ink droplets are ejected from the nozzle openings 25. As the ink droplets are mounted on the subject onto which liquid is ejected, middle dots are formed at this position.

The first small-dot ejection pulse DPS1 of the first driving signal COM1 generated in the period T12 and the second small-dot ejection pulse DPS2 of the second driving signal COM2 generated in the period T22 are composed of a second expansion element P21, a second expansion holding element P22, a second contraction element P23, a contraction holding element P24, and a third contraction element P25. The second expansion element P21 is a waveform element to boost potential from the reference potential Vhb to a second expansion potential Vh2. The second expansion holding element P22 is a waveform element constantly at the second expansion potential Vh2. The second contraction element P23 is a waveform element to sharply lower potential from the second expansion potential Vh2 to an ejection potential Vh3. The contraction holding element P24 is a waveform element constantly at the ejection potential Vh3. The third contraction element P25 is a waveform element to lower potential from the ejection potential Vh3 to the reference potential Vhb.

Upon the supply of the small-dot ejection pulses DPS1 and DPS2 to the piezoelectric oscillating element 20, the element 20 rapidly contracts in the longitudinal direction because of the second expansion element P21, whereby the insular portion 34 moves away from the pressure chamber 28. This movement of the insular portion 34 causes the pressure chamber 28 to expand from the reference volume to an expanded volume based on the second expansion potential Vh2. This expansion of the pressure chamber 28 causes a relatively strong negative pressure in the pressure chamber 28, pulling the meniscus toward the pressure chamber 28. At the same time, the pressure chamber 28 is provided with ink from the common ink chamber 26. The expanded state of the pressure chamber 28 is maintained for a period when the second expansion holding element P22 is supplied. During this period, the movement direction of the center of the meniscus is inverted to the ejection direction, and the center is raised like a column. This part is hereinafter referred to as the "column part".

Subsequently, the piezoelectric oscillating element 20 stretches when the second contraction element P23 is supplied. This stretch of the oscillating element 20 causes the rapid movement of the insular portion 34 toward the pressure chamber 28. This movement of the insular portion 34 makes the pressure chamber 28 rapidly contract from the expanded volume to an ejection volume based on the ejection potential Vh3. This rapid contraction of the pressure chamber 28 pressurizes the ink contained in the pressure chamber 28, whereby the column part of the meniscus is pulled toward the ejection side. Then the contraction holding element P24 is supplied and the ejection volume is maintained for a short time. Subsequently, the oscillating element 20 stretches when the third contraction element P25 is supplied. This stretch of the oscillating element 20 makes the insular portion 34 come back to the position based on the reference potential Vhb. Accordingly, the pressure chamber 28 recovers to the reference volume from the ejection volume. During a period for supplying the contraction holding element P24 and third contraction element P25, the column part in the center of the meniscus is divided, whereby an ink droplet in a small-dot amount is ejected. As the ink droplet is mounted on the subject, a small dot is formed at this position.

To form large dots by using the driving signals COM1 and COM2, the middle-dot ejection pulse and small-dot ejection pulse are supplied consecutively in the same ejection cycle to the piezoelectric oscillating element 20 so as to eject middle-dot and small-dot ink droplets. The droplets are mounted next to each other on the subject, whereby large droplets can be formed.

The first micro-vibrating pulse VP1 of the first driving signal COM1 generated in the period T13 and the second micro-vibrating pulse VP2 of the second driving signal COM2 generated in the period T23 are composed of a micro-vibrating expansion element P31, a micro-vibrating holding element P32, and a micro-vibrating contraction element P33. The micro-vibrating expansion element P31 comparatively gradually boosts potential from the reference potential Vhb to a micro-vibrating potential Vh4 in order to expand the pressure chamber 28. The micro-vibrating holding element P32 maintains the micro-vibrating potential Vh4 for an extremely short time. The micro-vibrating contraction element P33 comparatively gradually recovers potential from the micro-vibrating potential Vh4 to the reference potential Vhd so as to make the pressure chamber 28, which has been expanded, contract to the reference volume.

Upon the supply of the micro-vibrating pulse VP to the piezoelectric oscillating element 20, the element 20 contracts because of the micro-vibrating expansion element P31, whereby the insular portion 34 moves away from the pressure chamber 28. Since the micro-vibrating potential Vh4 of the micro-vibrating pulse VP is set smaller than the first expansion potential Vh1 of the middle-dot ejection pulses DPM1 and DPM2 and the second expansion potential Vh2 of the small-dot ejection pulses DPS1 and DPS2, the movement of the insular potential 34 is smaller than the middle or small-dot ejection pulses. Accordingly, the pressure chamber 28 expands more gradually. As the micro-vibrating contraction element P33 is supplied after the expanded state of the pressure chamber 28 is maintained by the micro-vibrating holding element P32 for a short time, the oscillating element 20 stretches to make the insular portion 34 come back to the position based on the reference potential Vhb. Accordingly, the pressure chamber 28 recovers to the reference volume. The series of changes in the volume of the pressure chamber 28 causes relatively gradual pressure changes in the chamber 28, thereby micro-vibrating the meniscus exposed to the nozzle openings 25. With the micro-vibrating of the meniscus, the ink placed around the nozzle openings 25 that has become increasing viscose is dispersed, thereby preventing the ink from becoming more viscose.

With the above-described recording head 8, as each pulse of the driving signals is selectively used to stretch the piezoelectric oscillating element 20 and thus to move the insular portion 34, thereby controlling the volume of the pressure chamber 28. In this manner, the pressure on the ink contained in the chamber 28 can be changed. This pressure change can be used for ejecting ink droplets from the nozzle openings 25 and micro-vibrating the meniscus.

Figure 9:
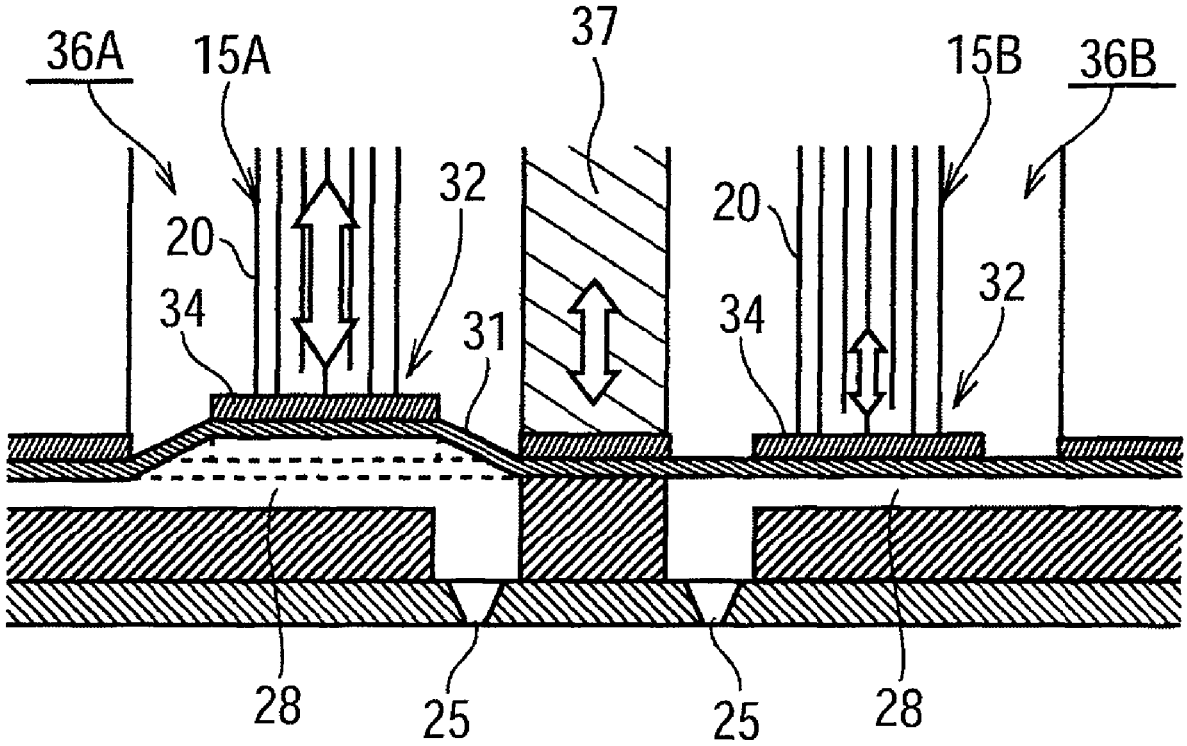
FIG. 9 shows how vibrations are transmitted in response to the driving of an oscillator unit.

To miniaturize the recording head 8 to have a lightweight and space-economical structure, a wall defining the accommodation chamber 36, particularly the partition wall 37 defining the adjacent accommodation chambers 36A, 36B in the head case 16, may be made thin. In addition, since the partition wall 37 may be joined to the head case 16 only at its sides in the longitudinal direction, as shown in FIG. 8, the wall is likely to vibrate upward and downward with its ends as supporting points. For example, as shown in FIG. 9, when the first oscillator unit 15A is driven to eject ink droplets, the stress generated as a result of a change in the shape of the resin film 31 by the movement of the insular portion 34 may possibly be transmitted to the partition wall 37, thereby vibrating the wall 37 upward and downward. The vibration of the wall 37 may possibly be transmitted to the diaphragm part 32 in the second oscillator unit 15B through the resin film 31, thereby adversely affecting the ejection of the ink droplets of the second oscillator unit 15B. In the same manner, the wall 37 may be excited to vibrate upon the driving of the second oscillator unit 15B, thereby adversely affecting the ejection of the ink droplets of the first oscillator unit 15A. For example, when both of the oscillator units 15A, 15B are driven simultaneously, ink droplets are ejected at the timing when the wall 37 moves in the opposite direction of the ejection direction. Accordingly, ink droplets are ejected at an ejection rate Vd that is lower than a target ejection rate Va that is achieved when only one oscillator unit 15 is driven.

Figure 10:
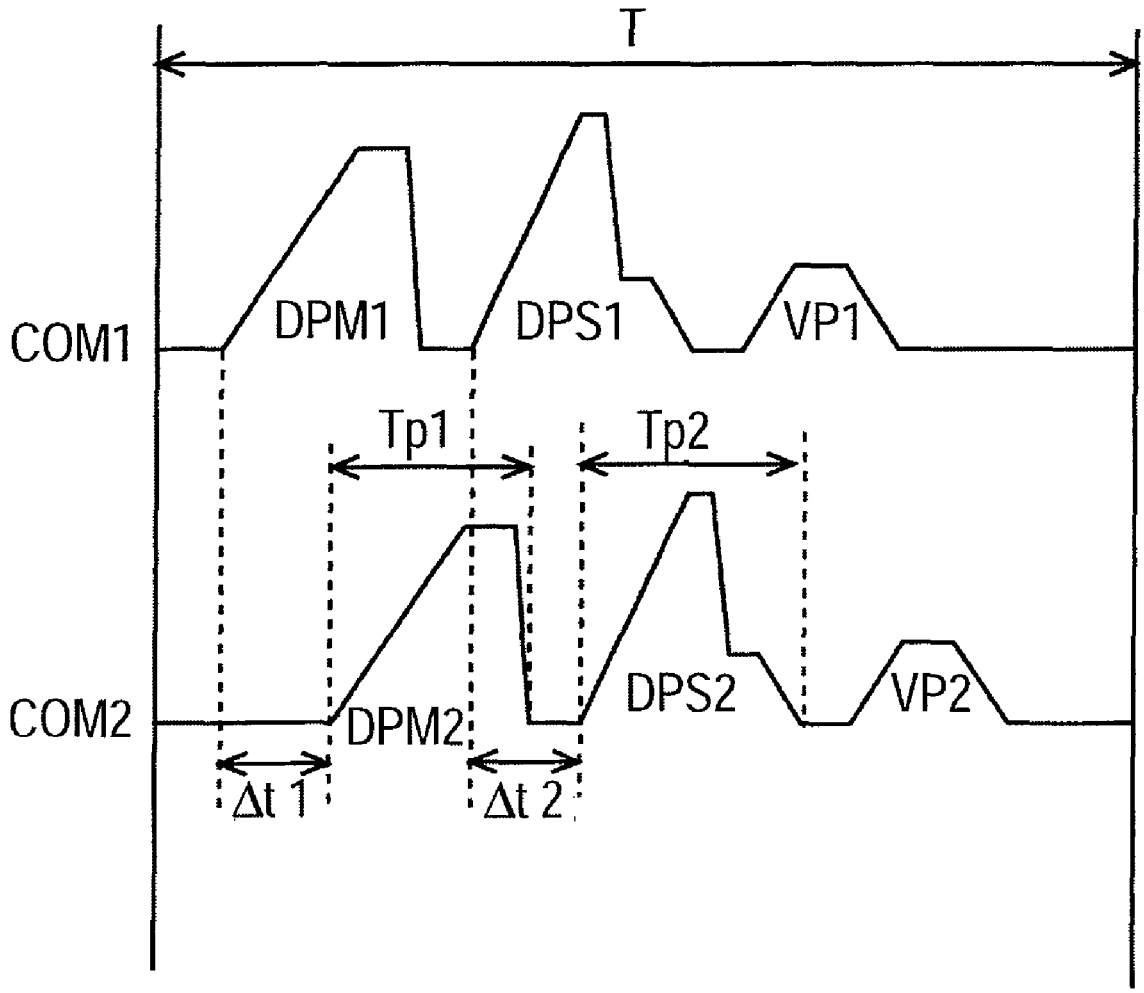
FIG. 10 is a timing chart showing the timing for generating each pulse of driving signals.

As the ejection rate Vd of ink droplets ejected gets lower than the target ejection rate Va, the airborne droplets may become mist, so that they cannot reach a subject (e.g. recording paper) onto which the ink is ejected. Also, the droplets may not be ejected straight, so that they cannot reach the expected position. These phenomena will degrade the quality of recorded images. In one embodiment, the printer 1 of the present invention ejects ink droplets with the oscillator units 15A, 15B driven in the same ejection cycle at a higher ejection rate Vd than the target ejection rate Va by staggering the timing for driving the oscillator units 15A, 15B. Specifically, as shown in FIG. 10, the timing for generating the second ejection pulse (the second middle-dot ejection pulse DPM2 and second small-dot ejection-pulse DPS2) of the second driving signal COM2 is delayed by a delay time Δt (Δt1, Δt2) from the generation of the first ejection pulse (the first middle-dot ejection pulse DPM1 and first small-dot ejection pulse DPS1) of the first driving signal COM1, as will now be described in greater detail. When referring to the timing of pulse generation, the timing is generally measured from the beginning of the each pulse (expansion element).

Figure 11:
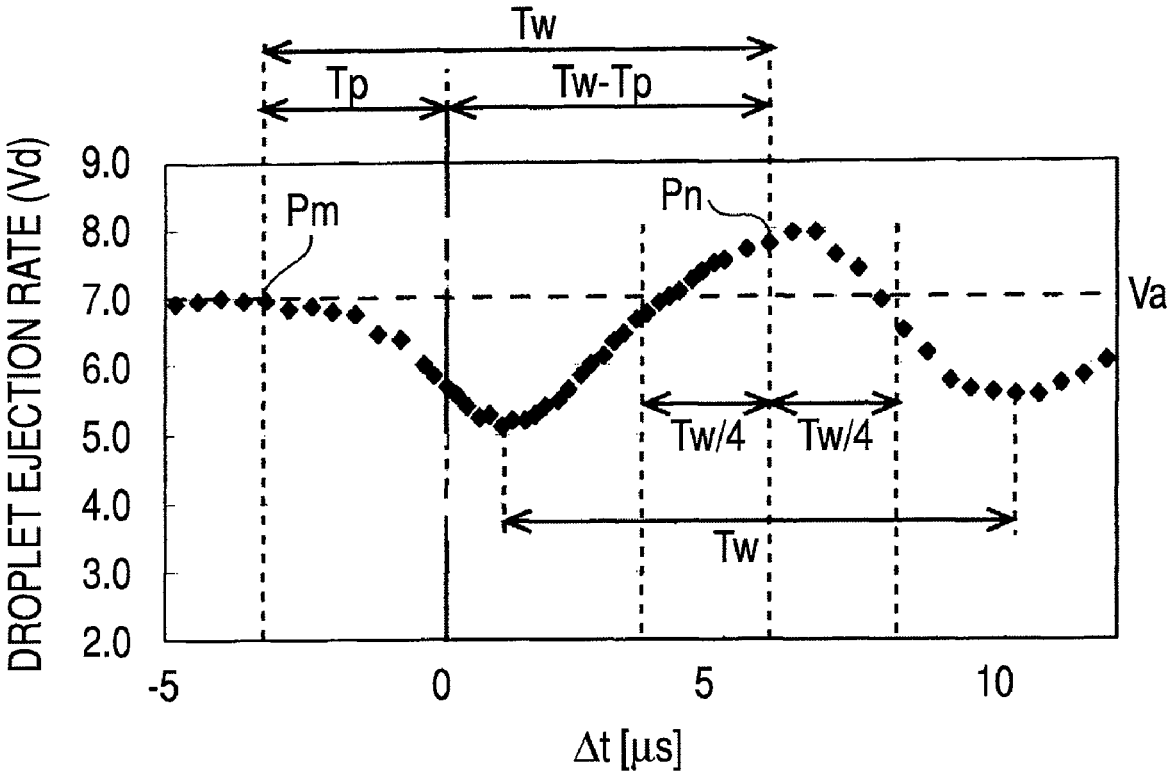
FIG. 11 is a graph illustrating a change in the ejection rate of ink droplets of the second oscillator unit in response to a change in delay time of the timing for generating a second ejection pulse of a second driving signal.

FIG. 11 is a graph illustrating a change in the ejection rate Vd (m/s) of ink droplets of the second oscillator unit 15B in response to a change in the delay time Δt (μs) of the timing for generating the second ejection pulse of the second driving signal COM2 when both of the oscillator units 15A, 15B are driven in the same ejection cycle to eject ink droplets. Referring to the graph, when the delay time Δt is 0, the first ejection pulse of the first driving signal COM1 and the second ejection pulse of the second driving signal COM2 are generated at the same time, in other words, the oscillator units 15A, 15B are driven at the same time. The delay time on the negative side means that the second ejection pulse comes before the first ejection pulse.

In the example of FIG. 11, the ejection rate Vd of ink droplets changes periodically after the boundary point Pm. When the delay time Δt is on the negative side before the boundary point Pm, the ejection rate Vd is constant at 7.0 m/s. When the delay time Δt is set at Pm, the timing of generating the second ejection pulse is staggered toward the negative side by a time period Tp required for generating the second ejection pulse (specifically, a driving time from the start of driving the piezoelectric oscillating element 20 of the second ejection pulse to the ejection of ink droplets) from the timing of generating the first ejection pulse. Accordingly, when the delay time Δt is set at or before the boundary point Pm, ink droplets can be ejected at the same ejection rate as when only the second oscillator unit 15B is driven with the second ejection pulse. Therefore, the ejection rate Vd (7.0 m/s) corresponds to the target ejection rate Va, which, in one embodiment, is when driving only the second oscillator unit 15B in the example of FIG. 11.

When the delay time is set after the boundary point Pm (toward the positive side), the first and second ejection pulses are ejected at the same time. Since the partition wall 37 is excited to vibrate upon the driving of the first oscillator unit 15A with the first ejection pulse, the ejection rate Vd of ink droplets becomes higher or lower than the target ejection rate Va depending on the phase of the vibration of the wall 37. In other words, the ejection rate of ink droplets decreases if they are ejected with the second ejection pulse at the timing when the wall 37 moves in the opposite direction of the ejection direction. Meanwhile, the ejection rate of ink droplets increases if they are ejected with the second ejection pulse at the timing when the wall 37 moves in the ejection direction. Therefore, the change cycle of the ejection rate Vd almost corresponds to the natural vibration cycle Tw of the wall 37.

In the example of FIG. 11, when the delay time Δt is set at a point Pn after the natural vibration cycle Tw of the partition wall 37 starting from the boundary point Pm, that is, set at Tw−Tp, the ejection rate Vd becomes almost the maximum. Within a range of plus or minus Tw/4 of Pn, the ejection rate Vd is equal to or higher than the target ejection rate Va. Therefore, the delay time Δt is set within the range of plus or minus Tw/4 of Tw−Tp with the printer 1, according to the present embodiment. For example, supposing that a time period Tp1 for generating the first middle-dot ejection pulse DPM1 as the first ejection pulse and the second middle-dot ejection pulse DPM2 as the second ejection pulse is 3 μs and the natural vibration cycle Tw of the partition wall 37 is 9 μs, the delay time Δt1 of the timing of generating the second middle-dot ejection pulse DPM2 from the generation of the first middle-dot ejection pulse DPM1 is set within a range plus or minus Tw/4=9/4=2.25 of Tw−Tp1=9−3=6 (μs). In other words, the delay time Δt1 is set to satisfy the formula 1:

$$3.75 \leqq \Delta t1 \leqq 8.25 \quad (1).$$

In the same manner, the delay time Δt2 of the timing of generating the second small-dot ejection pulse DPS2 from the generation of the first small-dot ejection pulse DPS1 falls within the range of plus or minus Tw/4 of Tw−Tp2.

By thus setting the delay time Δt, the driving signals COM1 and COM2 can be ejected alternatively, while the signals COM1 and COM2 are ejected partly at the same time in the example of FIG. 10.

By setting the delay time Δt of the timing of generating the second ejection pulse from the generation of the first ejection pulse, the ejection rate Vd of ink droplets of the second oscillator unit 15B can be equal to or higher than the target ejection rate Va even when both the oscillator units 15A, 15B are driven in the same ejection cycle to eject ink droplets. In addition, by thus setting the delay time Δt of the timing of generating the second ejection pulse, the first oscillator unit 15A can be driven without an influence of the vibration of the partition wall 37 made by the driving of the second oscillator unit 15B. Accordingly, the ejection rate Vd of ink droplets ejected by the driving of the oscillator units 15A, 15B can be equal to or higher than the target ejection rate Va. It is therefore possible to prevent ink droplets from becoming mist and deviating, thereby accurately mounting the droplets on the subject. Consequently, the quality of recorded images are enhanced.

It should be noted that the invention is not limited to the above-described embodiment, and various changes and modifications can be made within the spirit and scope of the claims.

For example, while the delay times Δt1 and Δt2 are set for the second middle-dot ejection pulse DPM2 and second small-dot ejection pulse DPS2, respectively, of the second driving signal COM2 from the timing of generating the corresponding ejection pulses (the first middle-dot ejection pulse DPM1 and first small-dot ejection pulse DPS1) of the first driving signal COM1 according to the first embodiment, the invention is not limited to this. It is also possible to set only the delay time Δt2 for the second small-dot ejection pulse DPS2 as the second minimum droplet ejection pulse for ejecting a minimum amount of droplets among the ejection pulses of the second driving signal COM2 from the timing of generating the first small-dot ejection pulse DPS1 as the first minimum droplet ejection pulse of the first driving signal COM1. Since droplets in a smaller amount are more likely to deviate or become mist because of the vibration of the partition wall 37, in one embodiment, at least the delay time Δt2 for the second small-dot ejection pulse DPS2 for ejecting a minimum amount of droplets among the plurality of ejection pulses of the driving signal is set as described above, thereby preventing a small-dot amount of ink droplets from becoming mist and deviating and thus accurately mounting ink droplets on the subject.

While the two oscillator units, namely, the first and second oscillator units 15A, 15B are provided corresponding to the two nozzle arrays according to the above-described embodiment, it is not intended to limit the invention. The invention is also applicable to a structure including more oscillator units. For example, the invention is applicable to a structure including four oscillator units corresponding to four nozzle arrays. In this case, for example, the first driving signal COM1 is used for some oscillator units corresponding to odd nozzle arrays, while the second driving signal COM2 is used for other oscillator units corresponding to even nozzle arrays.

It should be noted that the invention is applicable not only to printers but other liquid jet apparatus whose ejection of liquid droplets is controllable by using a plurality of driving signals. Examples of such apparatus may include plotters, facsimile machines, copy machines, various types of inkjet recording apparatus, and other liquid jet apparatus than those used for recording purposes, such as display-manufacturing apparatus, electrode-manufacturing apparatus, and chip-manufacturing apparatus.

What is claimed is:

1. A liquid jet apparatus, comprising:

a liquid jet head, comprising;

a canal unit comprising a continuous liquid canal from a common liquid chamber to a nozzle opening via a pressure chamber, and having a diaphragm part that changes a volume of the pressure chamber;

a first actuator unit and a second actuator unit, each including a pressure generating element configured to change a shape of the diaphragm part to change pressure on liquid contained in the pressure chamber; and a head case having at least one accommodation chamber to accommodate the first and second actuator units and a canal fixing surface to fix the canal unit, the at least one accommodation chamber including a first accommodation chamber, a second accommodation chamber, with a partition wall placed between the first accommodation chamber and the second accommodation chamber; and the liquid jet head configured to eject a liquid droplet from the nozzle opening by driving of the pressure generating element to change the pressure on the liquid contained in the pressure chamber; and a driving signal generating circuit configured to generate driving signals including ejection pulses to drive the pressure generating element to eject the liquid droplet, the driving signals including a first driving signal being supplied to the first actuator unit and a second driving signal being supplied to the second actuator unit, wherein the first driving signal includes a first ejection pulse and the second driving signal includes and a second ejection pulse, the second ejection pulse being initiated after a delay time Δt from the time at which the first ejection pulse is initiated, and wherein the delay time Δt falls within a range of plus or minus Tw/4 of Tw−Tp, where Tw represents a natural vibration cycle of the partition wall and Tp represents a time delay between the time at which the pressure generating element is driven with the second ejection pulse of the second driving signal and the time at which the liquid droplet is ejected.

2. The liquid jet apparatus according to claim 1, wherein the delay time Δt is within a range of delay time Δt which causes the liquid droplets to have reduced mist and reduced deviation from a predetermined path.

3. The liquid jet apparatus according to claim 1, wherein the delay time Δt is set within a range that allows a liquid droplet ejection rate Vd to be greater or equal to a liquid droplet ejection rate Va, where Vd is the liquid droplet ejection rate of the second actuator unit when both the first and second actuator units are driven to eject liquid droplets, and where Va is the liquid droplet ejection rate when one of the first and second actuator units is driven to eject a liquid droplet.

4. The liquid jet apparatus according to claim 3, wherein Vd is the liquid droplet ejection rate of the second actuator unit when both the first and second actuator units are driven to eject liquid droplets at an identical ejection cycle.

5. The liquid jet apparatus according to claim 1, wherein the first and second driving signals include a plurality of ejection pulses for ejecting different amounts of liquid droplets in an identical ejection cycle, and each ejection pulse of the second driving signal is generated after the delay time Δt from when the first ejection pulses of the first driving signal are initiated.

6. The liquid jet apparatus according to claim 1, wherein the first and second driving signals include a plurality of ejection pulses for ejecting different amounts of liquid droplets in an identical ejection cycle, and at least a second droplet ejection pulse of the ejection pulses of the second driving signal for ejecting a minimum droplet amount is generated with the delay time Δt from when the a first minimum droplet ejection pulse of the first driving signal is initiated.

7. The liquid jet apparatus according to claim 1, wherein the head case further comprises a first accommodation chamber, a second accommodation chamber, and a partition wall placed between the first accommodation chamber and the second accommodation chamber.

8. In a liquid jet apparatus comprising a liquid jet head, the liquid jet head comprising a canal unit having a diaphragm part that changes a volume of a pressure chamber, a first actuator unit, a second actuator unit, a head case having a first accommodation chamber to accommodate the first actuator unit, a second accommodation chamber to accommodate the second actuator unit, and a partition wall placed between the first accommodation chamber and the second accommodation chamber, each actuator unit including a pressure generating element configured to change a shape of the diaphragm part to change pressure on liquid contained in the pressure chamber, a method for ejecting a liquid droplet from the liquid jet head, the method comprising:

generating a first ejection pulse from a first driving signal supplied to the first actuator unit to drive the pressure generating element to eject a liquid droplet;

waiting for a delay time Δt from the time at which the first ejection pulse is initiated; and generating a second ejection pulse from a second driving signal supplied to the second actuator unit to drive the pressure generating element to eject a liquid droplet, wherein the delay time Δt falls within a ranqe of plus or minus Tw/4 of Tw−Tp, where Tw represents a natural vibration cycle of the partition wall and Tp represents a time delay between the time at which the pressure generating element is driven with the second ejection pulse of the second driving signal and the time at which the liquid droplet is ejected.

9. The method as recited in claim 8, wherein the delay time Δt falls within a range that results in the liquid droplets having reduced mist and reduced deviation from a predetermined path.

10. The method as recited in claim 8, wherein the delay time Δt is set within a range that allows a liquid droplet ejection rate Vd to be greater or equal to a liquid droplet ejection rate Va, where Vd is the liquid droplet ejection rate of the second actuator unit when both the first and second actuator units are driven to eject liquid droplets, and where Va is the liquid droplet ejection rate when one of the first and second actuator units is driven to eject a liquid droplet.

11. The method as recited in claim 8, wherein the first and second driving signals include a plurality of ejection pulses for ejecting different amounts of liquid droplets in an identical ejection cycle, and each ejection pulse of the second driving signal is generated after the delay time Δt from when the first ejection pulses of the first driving signal are initiated.

12. The method as recited in claim 8, wherein the first and second driving signals include a plurality of ejection pulses for ejecting different amounts of liquid droplets in an identical ejection cycle, and at least a second droplet ejection pulse of the ejection pulses of the second driving signal for ejecting a minimum droplet amount is generated with the delay time Δt from when the a first minimum droplet ejection pulse of the first driving signal is initiated.

13. A liquid jet apparatus, comprising:

a liquid jet head, comprising;

a canal unit comprising a continuous liquid canal from a common liquid chamber to a nozzle opening via a pressure chamber, and having a diaphragm part that changes a volume of the pressure chamber;

a first actuator unit and a second actuator unit, each including a pressure generating element configured to change a shape of the diaphragm part to change pressure on liquid contained in the pressure chamber; and a head case having at least one accommodation chamber to accommodate the actuator unit and a canal fixing surface to fix the canal unit, the at least one accommodation chamber including a first accommodation chamber to accommodate the first actuator unit, a second accommodation chamber to accommodate the second actuator unit, with a partition wall placed between the first accommodation chamber and the second accommodation chamber, and the liquid jet head configured to eject a liquid droplet from the nozzle opening by driving of the pressure generating element to change the pressure on the liquid contained in the pressure chamber; and a driving signal generating circuit configured to generate driving signals including ejection pulses to drive the pressure generating element to eject the liquid droplet, the driving signals including a first driving signal being supplied to the first actuator unit and a second driving signal being supplied to the second actuator unit, wherein the first driving signal includes a first ejection pulse and the second driving signal includes and a second ejection pulse, the second ejection pulse being initiated after a delay time Δt from the time at which the first ejection pulse is initiated, and wherein the delay time Δt is set within a range that allows a liquid droplet ejection rate Vd is greater or equal to a liquid droplet ejection rate Va, where Vd is the liquid droplet ejection rate of the second actuator unit when both the first and second actuator units are driven to eject liquid droplets, and where Va is the liquid droplet ejection rate when one of the first and second actuator units is driven to eject a liquid droplet, and wherein the delay time Δt falls within a range of plus or minus Tw/4 of Tw−Tp, where Tw represents a natural vibration cycle of the partition wall and Tp represents a time delay between the time at which the pressure generating element is driven with the second ejection pulse of the second driving signal and the time at which the liquid droplet is elected.

14. The liquid jet apparatus according to claim 13, wherein Vd is the liquid droplet ejection rate of the second actuator unit when both the first and second actuator units are driven to eject liquid droplets at an identical ejection cycle.

15. The liquid jet apparatus according to claim 13, wherein the head case comprises a first accommodation chamber to accommodate the first actuator unit and a second accommodation chamber to accommodate the second actuator unit with a partition wall placed between the first accommodation chamber and the second accommodation chamber, wherein the first and second accommodation chambers form a through hole penetrating the head case in from the canal fixing surface to an upper surface of the head case.

16. The liquid jet apparatus according to claim 13, wherein the canal unit further comprises a nozzle plate having a plurality of nozzle openings, a canal-forming substrate for forming the continuous liquid canal, and an oscillating plate for sealing an opening surface of the pressure chamber.

17. The liquid jet apparatus according to claim 13, wherein the driving signals are comprised of a middle-dot ejection pulse for ejecting a middle-dot amount of ink droplets and a small-dot ejection pulse for ejecting a small-dot amount of ink droplets.

* * * * *